US008371888B2

(12) United States Patent
To

(10) Patent No.: US 8,371,888 B2
(45) Date of Patent: Feb. 12, 2013

(54) MOVABLE FLOATING OBJECT AND DRIVING MECHANISM THEREFOR

(76) Inventor: Chau Ngok Tracy To, Hong Kong (HK)

( * ) Notice: Subject to any disclaimer, the term of this patent is extended or adjusted under 35 U.S.C. 154(b) by 161 days.

(21) Appl. No.: 12/965,929

(22) Filed: Dec. 13, 2010

(65) Prior Publication Data

US 2012/0145067 A1 Jun. 14, 2012

(51) Int. Cl.
*B63C 9/08* (2006.01)

(52) U.S. Cl. ..... 441/130; 114/345; 440/38

(58) Field of Classification Search ..... 114/345; 440/38; 441/130, 129, 132
See application file for complete search history.

(56) References Cited

U.S. PATENT DOCUMENTS 1,023,515 A * 4/1912 Graves ..... 440/38
2,616,385 A * 11/1952 Woods ..... 440/38
3,492,965 A 2/1970 Wayfield
4,700,648 A 10/1987 Trefethern et al.
4,942,838 A * 7/1990 Boyer et al. ..... 114/345
5,403,220 A 4/1995 Goad, Sr.
5,967,864 A * 10/1999 Koyano et al. ..... 440/38
6,554,660 B2 * 4/2003 Irish ..... 440/38

FOREIGN PATENT DOCUMENTS

GB 2461539 1/2010

OTHER PUBLICATIONS

European Search Report of Patent Application No. EP10195246.

* cited by examiner

*Primary Examiner* — Lars A Olson

(57) ABSTRACT

A movable floating object includes a floatable body and water pumps mounted on the left and right sides of the body respectively. Intake tubes are coupled to the pumps through intake valves respectively. Discharge tubes are coupled to the pumps respectively. Exertion of force on the pumps forces water out of the pumps and through the discharge tubes, and release of the force creates a vacuum inside the pumps that sucks water into the pumps through the intake tubes and the intake valves respectively. The floatable body moves forwards when same force applied to the pumps and turns when the forces apply to the pumps are different.

18 Claims, 4 Drawing Sheets

MOVABLE FLOATING OBJECT AND DRIVING MECHANISM THEREFOR

FIELD OF PATENT APPLICATION

The present application relates to a movable floating object and a driving mechanism for a floating object.

BACKGROUND

Inflatable boats, canoes, loungers, rings, tubes and ride-on, etc. are popular water toys at the pool and on the beach. However, most of these inflatable objects can only float on water. Some inflatable objects may be incorporated with electric motors which are big and expensive. In addition, the electric motors consume power and that means more and more energy would be wasted.

There is a need to produce a floatable object with a natural power driving mechanism that is simpler in construction, less expensive and save energy.

The above description of the background is provided to aid in understanding a movable floating object, but is not admitted to describe or constitute pertinent prior art to the movable floating object disclosed in the present application, or consider any cited documents as material to the patentability of the claims of the present application.

SUMMARY

According to one aspect, there is provided a movable floating object including:

a floatable body;

first and second water pumps mounted on the left and right sides of the body respectively;

first and second intake tubes each having an inlet end submerged in water and a pump-connecting end, the pump-connecting ends of the first and second intake tubes being coupled to and in fluid communication with the first and second pumps through first and second intake valves respectively; and first and second discharge tubes each having a discharge end submerged in water and a pump-connecting end, the pump-connecting ends of the first and second discharge tubes being coupled to and in fluid communication with the first and second pumps respectively;

wherein exertion of force on the pumps forces water out of the pumps and through the discharge tubes, and release of the force creates a vacuum inside the pumps that sucks water into the pumps through the intake tubes and the intake valves respectively; and wherein the floatable body moves forwards when same force applied to the pumps and turns when the forces apply to the pumps are different.

In one embodiment, the floatable object is an inflatable object.

In one embodiment, the inlet ends of the first and second intake tubes are located at a lower front portion of the body.

In one embodiment, the outlet ends of the first and second discharge tubes are located at a lower rear portion of the body.

In one embodiment, the first and second discharge tubes extend generally downwardly, rearwardly and convergently from the water pump.

In one embodiment, the first and second discharge tubes are substantially straight.

In one embodiment, the first and second water pumps are located at an upper portion of the body.

In one embodiment, the floatable body is in the shape of a sofa having a seat portion and two armrest portions.

In one embodiment, the first and second pumps are located on the two armrest portions respectively.

According to another aspect, there is provided a driving mechanism for a floating object. The driving mechanism includes:

a water pump mounted on a floatable body of the floating object;

an intake tube having an inlet end submerged in water and a pump-connecting end coupled to and in fluid communication with the pump through an intake valve; and a discharge tube having a discharge end submerged in water and a pump-connecting end coupled to and in fluid communication with the pump;

wherein exertion of force on the pump forces water out of the pump and through the discharge tube, and release of the force creates a vacuum inside the pump that sucks water into the pump through the intake tube and the intake valve; and wherein the floatable body moves in a direction generally opposite to water discharge from the discharge tube.

In one embodiment, the floatable body is an inflatable object.

In one embodiment, the inlet end of the intake tube is located at a lower front portion of the body.

In one embodiment, the discharge end of the discharge tube is located at a lower rear portion of the body.

In one embodiment, the discharge tube extends downwardly and rearwardly from the water pump.

In one embodiment, the discharge tube is substantially straight.

In one embodiment, the pump is located at an upper portion of the body.

In one embodiment, the pump is sized and shaped to be grasped by a hand.

In one embodiment, the pump is generally cylindrical in shape.

In one embodiment, the intake valve is provided between the intake tube and the water pump.

In one embodiment, the water pump, the intake tube and the discharge tube are made of plastic.

Although the movable floating object disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the movable floating object disclosed in the present application will now be described by way of example with reference to the accompanying drawings wherein.

DETAILED DESCRIPTION

Figure 1:
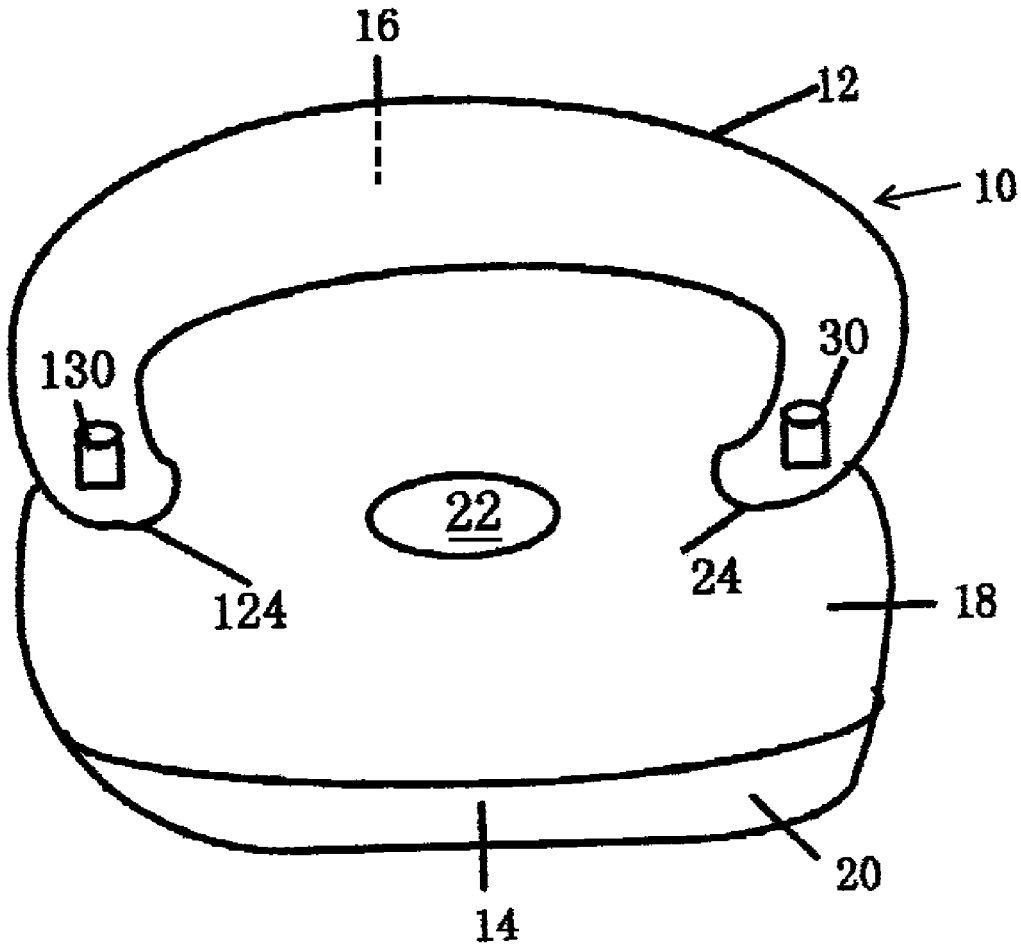
FIG. 1 is an illustrative diagram of a movable floating object according to an embodiment disclosed in the present application.

Reference will now be made in detail to a preferred embodiment of the movable floating object disclosed in the present application, examples of which are also provided in the following description. Exemplary embodiments of the movable floating object disclosed in the present application are described in detail, although it will be apparent to those skilled in the relevant art that some features that are not particularly important to an understanding of the movable floating object may not be shown for the sake of clarity.

Furthermore, it should be understood that the movable floating object disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

Certain terminology is used in the following description for convenience only and is not limiting. The words "left", "right", "front", "back", "upper", and "lower" designate directions in the drawings to which reference is made. The terminology includes the words noted above as well as derivatives thereof and words of similar import.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

FIG. 1 is an illustrative diagram of a movable floating object 10 according to an embodiment disclosed in the present application. The floating object 10 may include a floatable body 12 having a front portion 14, a back portion 16, an upper portion 18 and a lower portion 20. The floatable body 12 can float on water such that when in use the upper portion 18 of the floatable body 12 may generally expose above the water level and the lower portion 20 of the floatable body 12 may generally submerge in water.

According to the illustrated embodiment, the floatable body 12 is in the form of a sofa when fully inflated by air using a conventional air pump. The floatable body 12 may be made of plastic or any other appropriate material. The floatable body 12 may have a seat 22 defined by the upper portion 18 of the floating object 10, and left and right armrests 24, 124.

Although it is shown and described that the floating object 10 is an inflatable sofa, it is understood that the floating object 10 may be in any shape and size suitable and convenient for the accommodation of at least one player thereon.

Although it has been shown and described that the floating object 10 is an inflatable sofa, it is understood that the floating object 10 can be an inflatable boat, an inflatable canoe, an inflatable ring, an inflatable tube, an inflatable ride-on, etc. It is also understood that the floating object 10 can be any other possible object that can float on water. For example, the floating object 10 can be made of a foam material or other buoyant material and formed into any appropriate shape.

Figure 2:
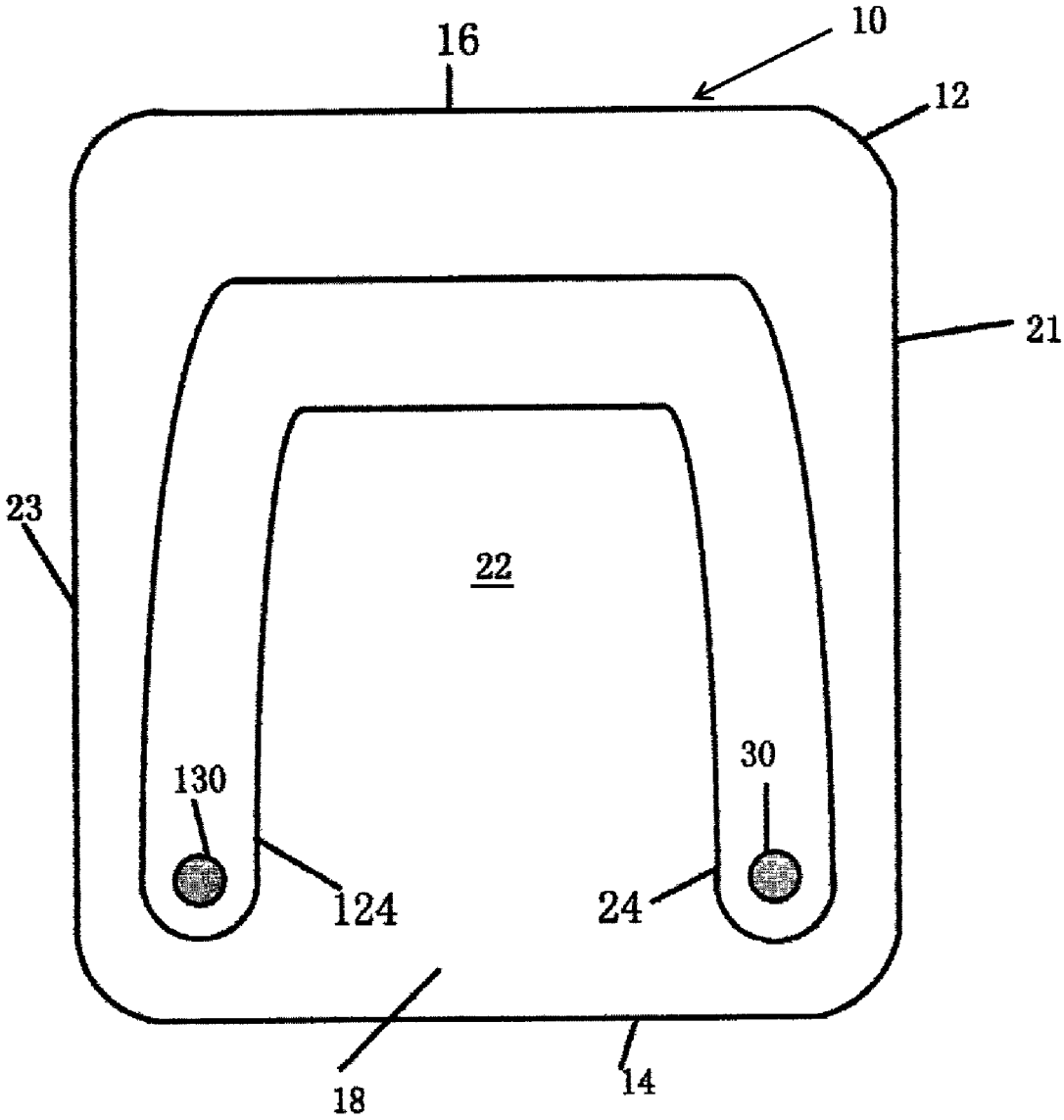
FIG. 2 is a top view of the movable floating object in FIG. 1.
Figure 3:
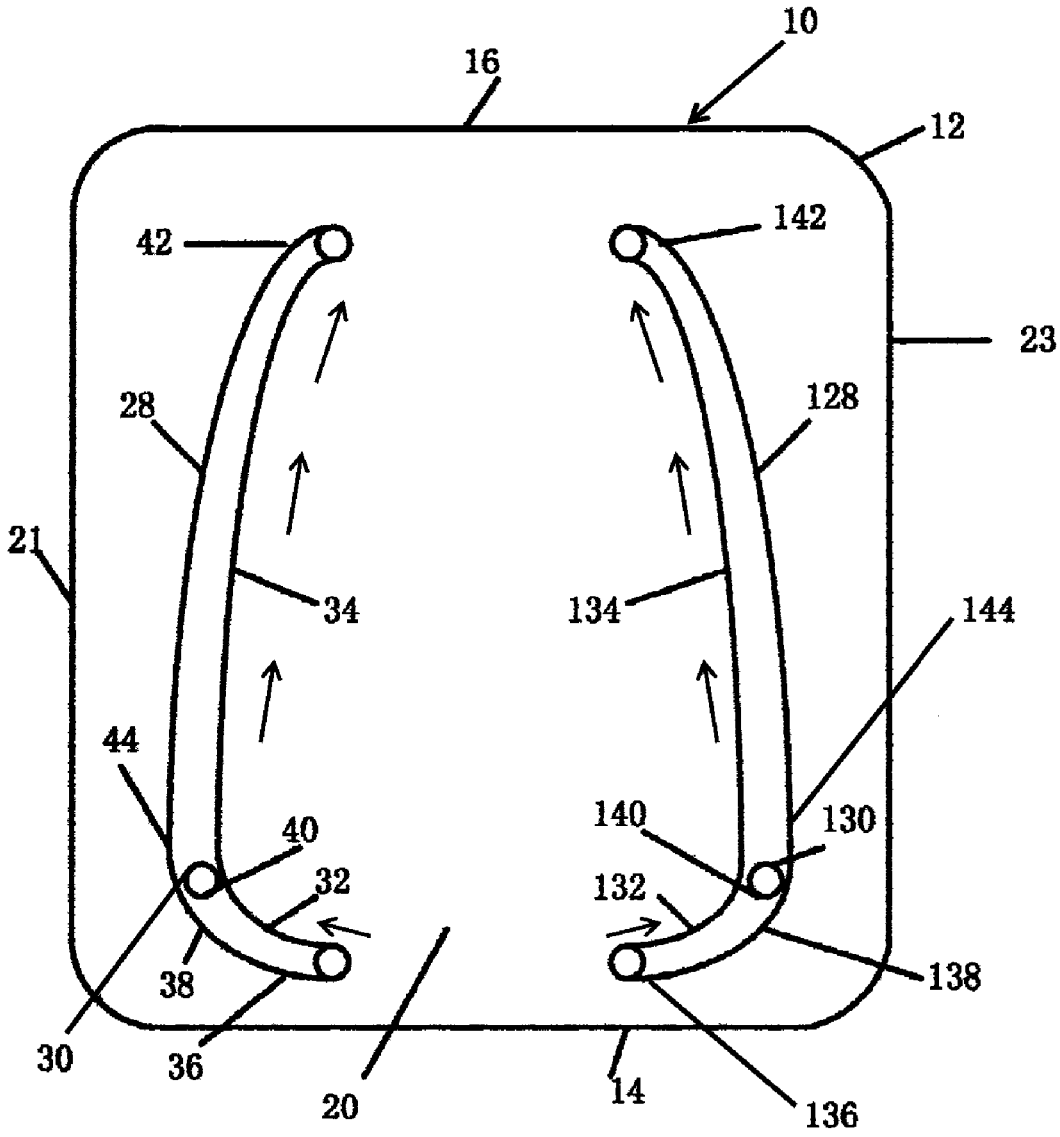
FIG. 3 is a bottom view of the movable floating object in FIG. 1.

FIGS. 2 and 3 are illustrative top and bottom views of the floating object 10 according to an embodiment of the present application. The floating object 10 may include two natural power driving mechanisms 28, 128 provided on the left and right sides 21, 23 of the floating object 10 respectively. The driving mechanism 28, 128 may include left and right hand pumps or water pumps 30, 130 operable by the left and right hands of a player respectively.

The water pumps 30, 130 may be located at a convenient position within reach by the player sitting at the center of the seat 22. According to the illustrated embodiment, the water pumps 30, 130 are located on the left and right armrests 24, 124 on the upper portion 18 of the floating object 10 respectively. The water pumps 30, 130 can be shaped and sized to facilitate easy grasping by the hands of the player. According to the illustrated embodiment, the water pumps 30, 130 are generally cylindrical in shape. The water pumps 30, 32 may be made of plastic or any other suitable material.

The water inlet ends 36, 136 of the intake tubes 32, 132 can be located at the lower front portion of the floatable body 12. This can ensure that the inlet ends 36, 136 can be submerged in water so that water can easily enter the intake tubes 32, 132. The discharge tubes 34, 134 may extend from the pumps 30, 130 generally downwardly, rearwardly and convergently inside the floatable body 12. The outlets of the discharge ends 42, 142 may be formed on the surfaces at the lower rear portion of the floatable body 12.

Although it has been shown and described that the floating object 10 has two natural power driving mechanisms, it is understood by one skilled in the art that the floating object 10 can have only one driving mechanism, or the floating object 10 may have more than two driving mechanisms.

Figure 4:
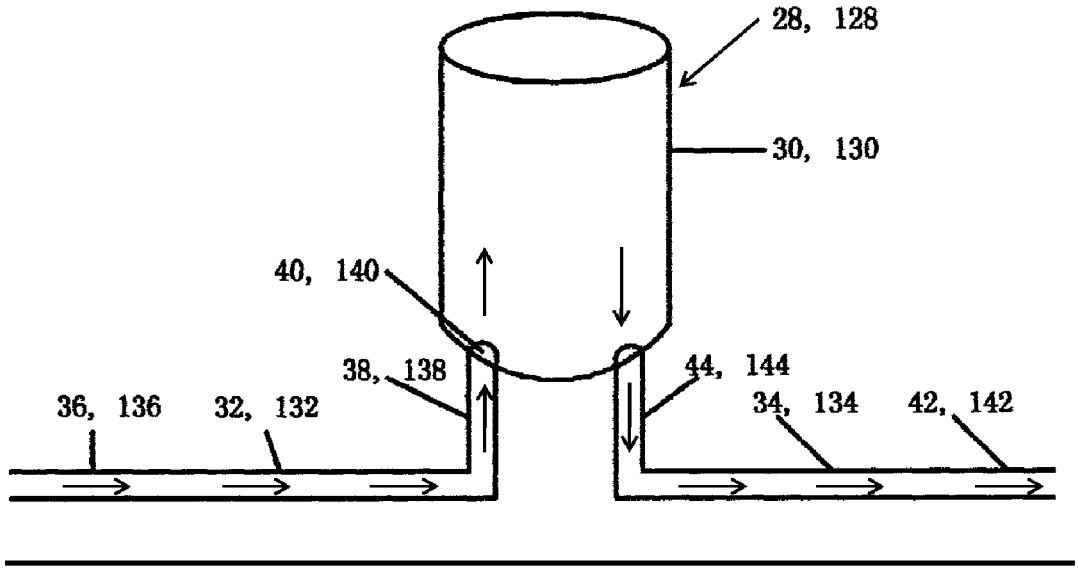
FIG. 4 is an illustrative diagram of the driving mechanism of the movable floating object according to an embodiment disclosed in the present application.

FIG. 4 shows the driving mechanism 28, 128 according to an embodiment of the application. The left water pump 30 can be operatively coupled to a water intake tube 32 and a water discharge tube 34. The intake tube 34 may have an inlet end 36 submerged in water and a pump-connecting end 38 coupled to and in fluid communication with the water pump 30 through an intake valve 40. The intake valve 40 only allows water to flow from the intake tube 32 into the pump 30, as shown by the arrows. The inlet valve 40 can be a flapper valve or any other suitable valve. The discharge tube 34 may have a discharge end 42 submerged in water and a pump-connecting end 44 coupled to and in fluid communication with the water pump 30.

Similarly, the right water pump 130 can be operatively coupled to a water intake tube 132 and a water discharge tube 134. The intake tube 134 may have an inlet end 136 submerged in water and a pump-connecting end 138 coupled to and in fluid communication with the water pump 130 through an intake valve 140. The intake valve 140 only allows water to flow from the intake tube 132 into the pump 130. The intake valve 140 can also be a flapper valve or any other suitable valve. The discharge tube 134 may have a discharge end 142 submerged in water and a pump-connecting end 144 coupled to and in fluid communication with the water pump 130.

Exertion of force on the water pumps 30, 130 forces water out of the water pumps 30, 130 and through the discharge tubes 34, 134. At this time, the intake valves 40, 140 are closed. Release of the force creates a vacuum inside the water pumps 30, 130 that sucks water into the pumps 30, 130 through the inlet tubes 32, 132 and the inlet valves 40, 140 respectively.

It is contemplated that the floating object 10 can move in reaction to water discharge from the discharge tubes 34, 134.

The floating object 10 can move in a direction generally opposite to the direction of water discharge from the discharge tubes 34, 134.

When a player applies same pumping force on the pumps 30, 130, the floating object would move forwards. When the player applies different pumping forces on the pumps 30, 130, the floating object 10 would turn either left or right.

While the movable floating object disclosed in the present application has been shown and described with particular references to a number of preferred embodiments thereof, it should be noted that various other changes or modifications may be made without departing from the scope of the appending claims.

What is claimed is:

1. A movable floating object comprising:

a floatable body;

first and second water pumps mounted on the left and right sides of the body respectively;

first and second intake tubes each having an inlet end submerged in water and a pump-connecting end, the pump-connecting ends of the first and second intake tubes being coupled to and in fluid communication with the first and second pumps through first and second intake valves respectively; and first and second discharge tubes each having a discharge end submerged in water and a pump-connecting end, the pump-connecting ends of the first and second discharge tubes being coupled to and in fluid communication with the first and second pumps respectively;

wherein exertion of force on the pumps forces water out of the pumps and through the discharge tubes, and release of the force creates a vacuum inside the pumps that sucks water into the pumps through the intake tubes and the intake valves respectively; and wherein the floatable body moves forwards when same force applied to the pumps and turns when the forces applied to the pumps are different;

wherein the floatable body is in the shape of a sofa having a seat portion and two armrest portions; and the first and second pumps are located on the two armrest portions respectively.

2. The movable floating object as claimed in claim 1, wherein the floatable object is an inflatable object.

3. The movable floating object as claimed in claim 1, wherein the inlet ends of the first and second intake tubes are located at a lower front portion of the body.

4. The movable floating object as claimed in claim 1, wherein the outlet ends of the first and second discharge tubes are located at a lower rear portion of the body.

5. The movable floating object as claimed in claim 1, wherein the first and second discharge tubes extend generally downwardly, rearwardly and convergently from the water pump.

6. The movable floating object as claimed in claim 1, wherein the first and second discharge tubes are substantially straight.

7. The movable floating object as claimed in claim 1, wherein the first and second water pumps are located at an upper portion of the body.

8. A driving mechanism for a floating object, the driving mechanism comprising:

a water pump mounted on a floatable body of the floating object;

an intake tube having an inlet end submerged in water and a pump-connecting end coupled to and in fluid communication with the pump through an intake valve; and a discharge tube having a discharge end submerged in water and a pump-connecting end coupled to and in fluid communication with the pump;

wherein exertion of force on the pump forces water out of the pump and through the discharge tube, and release of the force creates a vacuum inside the pump that sucks water into the pump through the intake tube and the intake valve; and wherein the floatable body moves in a direction generally opposite to water discharge from the discharge tube;

the pump is located on an armrest portion of the floating object.

9. The driving mechanism as claimed in claim 8, wherein the floatable body is an inflatable object.

10. The driving mechanism as claimed in claim 8, wherein the inlet end of the intake tube is located at a lower front portion of the body.

11. The driving mechanism as claimed in claim 8, wherein the discharge end of the discharge tube is located at a lower rear portion of the body.

12. The driving mechanism as claimed in claim 8, wherein the discharge tube extends downwardly and rearwardly from the water pump.

13. The driving mechanism as claimed in claim 8, wherein the discharge tube is substantially straight.

14. The driving mechanism as claimed in claim 8, wherein the pump is located at an upper portion of the body.

15. The driving mechanism as claimed in claim 8, wherein the pump is sized and shaped to be grasped by a hand.

16. The driving mechanism as claimed in claim 8, wherein the pump is generally cylindrical in shape.

17. The driving mechanism as claimed in claim 8, wherein the intake valve is provided between the intake tube and the water pump.

18. The driving mechanism as claimed in claim 8, wherein the water pump, the intake tube and the discharge tube are made of plastic.

* * * * *